US007857246B2

(12) United States Patent
Sued et al.

(10) Patent No.: US 7,857,246 B2
(45) Date of Patent: Dec. 28, 2010

(54) SHREDDER ADAPTED TO DETECT A FULL SHREDDER BASKET

(76) Inventors: Charles Sued, c/o Executive Machines Inc., P.O. Box 320150, Brooklyn, NY (US) 11232; Aron Abramson, c/o Executive Machines Inc., P.O. Box 320150, Brooklyn, NY (US) 11232

( * ) Notice: Subject to any disclaimer, the term of this patent is extended or adjusted under 35 U.S.C. 154(b) by 0 days.

(21) Appl. No.: 12/041,636

(22) Filed: Mar. 3, 2008

(65) Prior Publication Data

US 2009/0218425 A1 Sep. 3, 2009

(51) Int. Cl.
*B02C 11/00* (2006.01)

(52) U.S. Cl. ..... 241/36; 241/100; 241/101.3

(58) Field of Classification Search ..... 241/26, 241/100, 101.3, 236, 36
See application file for complete search history.

(56) References Cited

U.S. PATENT DOCUMENTS 3,882,770 A * 5/1975 Bleasdale ..... 100/49
6,978,954 B2 12/2005 Kroger et al.

* cited by examiner

*Primary Examiner*—Faye Francis
(74) *Attorney, Agent, or Firm*—Garcia-Zamor IP Law; Ruy M. Garcia-Zamor

(57) ABSTRACT

A shredder having a feature which prevents shredder operation or provides a user alert when the accumulation of shredded material in the disposal basket has reached the capacity of the basket.

13 Claims, 15 Drawing Sheets

SHREDDER ADAPTED TO DETECT A FULL SHREDDER BASKET

BACKGROUND

The present invention is generally directed to shredders and, more specifically, to a mechanism for interrupting shredder operation when capacity of its shredded material storage basket has been reached.

Conventional shredders have a bin for collection of shredded material, generally located below the shredder blades, to accumulate shredded material for future disposal. An area at the front of the bin may be lowered or transparent to allow a user to observe the level of shredded material, or the bin may be of wire mesh to allow a user to observe the level of the shredded material and judge when the bin must be emptied.

However, relying upon the judgement of the user to determine when the bin must be emptied can be problematic. In a situation where a shredder has multiple users, there is no requirement for a particular user to empty the shredder bin after it has reached its capacity, even if the user observes the shredder should be emptied to allow optimal operation. If the shredder continues to be operated when the shredded material exceeds the capacity of the bin, operation of the shredder can be impaired and the shredder may be damaged by continued use. If the shredder continues to deposit material into the bin after a reasonable capacity has been exceeded, shredded material may overflow into the shredder enclosure upon bin removal and require it to be cleaned before the bin can be reinserted. Spilled shredded material can also negatively impact appearance of the work area.

It may be advantageous to provide a shredder that provides a method for preventing shredder operation when the shredded material in the storage bin has reached a level where its accumulation will interfere with optimal operation of the shredder.

SUMMARY

Briefly speaking, one preferred embodiment of the present invention is directed to a shredder. The shredder includes a shredder housing and a basket removeably positioned in the housing for collection of shredded material. The shredder housing defines a slot adapted to receive material to be shredded. A plurality of shredder blades are disposed within the shredder housing and are adapted to shred the material inserted into the slot and eject it along a material discharge path into the basket. Two lateral sides of the basket define a bore through which light can pass in order to laterally transverse the basket and detect the level of material in the basket. A sensor is located on the lateral wall of the shredder housing and determines when a light beam has been interrupted by the shredded material in the basket. A controller is in communication with the shredder and is adapted to cause the plurality of shredder blades to deactivate. When the controller receives a signal from the sensor indicating the light beam has been blocked, the controller stops the activation of the plurality of shredder blades.

In another aspect, the present invention is directed to a method of shredding material and depositing it into a basket while reducing the possibility that shredded material will accumulate and exceed the capacity of the basket. The method includes the steps of: providing a shredder including a shredder housing defining a slot adapted to receive material to be shredded and a basket for collection of shredded material. A plurality of shredder blades are disposed within the shredder head housing and are adapted to shred the material inserted into the slot and eject it along a material discharge path into the basket. The method further includes: providing a light permeable section in the lateral sides of the basket; directing a light beam laterally across the basket such that it is not interrupted by the material discharge path; monitoring the light beam to detect if the level of shredded material reaches a certain height in the basket; stopping the activation of the plurality of shredder blades while the light beam is interrupted.

In another aspect, the present invention is directed to a shredder having a shredder housing and a basket removeably positioned within the housing and an associated feature for detecting the level of material deposited in the basket. Two lateral sides of the basket define a bore through which light can pass in order to laterally transverse the basket and detect the level of material in the basket. The bore can be open or covered by a material which is at least partially transparent. Each lateral side of the basket incorporates a plate that blocks the light permeable part of the basket when the basket is removed from the shredder housing, and moves to permit the passage of light when the basket is properly seated in the shredder housing. Accumulation of shredded material can interrupt the light beam, as can partial removal of the basket from the shredder housing.

In another aspect, the present invention is directed to a method of shredding material and depositing it into a basket while reducing the possibility that shredded material will accumulate and exceed the capacity of the basket. The method includes the steps of: providing light permeable sections in the lateral sides of the basket; directing a light beam through these permeable sections laterally across the basket such that it is not interrupted by the material discharge path; providing a movable plate attached to the basket walls which covers this section upon removal of the basket; monitoring the light beam to detect if the level of shredded material reaches a certain height in the basket or if the basket is partially removed from the basket; stopping the activation of the plurality of shredder blades while the light beam is interrupted.

In another aspect, the present invention is directed to a shredder having a shredder housing and a basket removeably positioned within the housing and an associated feature for detecting the level of material deposited in the basket. Two lateral sides of the basket define a bore through which light can pass in order to laterally transverse the basket and detect the level of material in the basket. The bore can be open or covered by a material which is at least partially transparent. Each lateral side of the shredder housing incorporates a mechanism which interrupts the transmission of light when the basket is partially or fully removed from the shredder housing, and permits the passage of light when the basket is properly seated in the shredder housing. Accumulation of shredded material can interrupt the light beam, as can partial removal of the basket from the shredder housing.

In another aspect, the present invention is directed to a method of shredding material and depositing it into a basket while reducing the possibility that shredded material will accumulate and exceed the capacity of the basket. The method includes the steps of: providing light permeable sections in the lateral sides of the basket; directing a light beam through these permeable sections laterally across the basket such that it is not interrupted by the material discharge path; providing a mechanism attached to the shredder housing which interrupts the transmission of light upon partial or full removal of the basket; monitoring the light beam to detect if the level of shredded material reaches a certain height in the basket or if the basket is partially removed from the basket;

stopping the activation of the plurality of shredder blades while the light beam is interrupted.

In another aspect, the present invention is directed to a shredder adapted to automatically detect when an associated shredder basket is filled with shredded material. The shredder includes a shredder housing including a chamber and a shredder head housing which defines a slot adapted to receive material to be shredded. A plurality of shredder blades are disposed within the shredder housing and are adapted to shred the material inserted into the slot and to eject the material along a material discharge path. The chamber is located on another side of the plurality of shredder blades from the slot. A controller is located in the shredder housing and is adapted to control the plurality of shredder blades. A shredder basket is removeably positioned in the chamber and is adapted to receive the material shredded by the plurality of shredder blades and to eject the material along the material discharge path. The shredder basket includes first and second lateral sides. A sensor is in communication with the controller and is adapted to determine when a light beam is interrupted by shredded material in the basket. The light beam extends through the first and second lateral sides of the shredder basket, extends generally laterally across the shredder basket, and is located generally outside of the material discharge path. A blocking mechanism is at least partially located in the chamber and is adapted to interrupt the light beam when the shredder basket is not fully engaged with the chamber. Wherein the controller deactivates the plurality of shredder blades while the sensor determines that the light beam is interrupted.

In a separate aspect, the present invention is directed to a method of detecting when a shredder basket is filled with shredded material. The method includes the steps of: providing a shredder housing including a shredder head housing which defines a slot adapted to receive material to be shredded; providing a plurality of shredder blades disposed within the shredder housing and adapted to shred the material inserted into the slot and to eject the material along a material discharge path; providing a shredder basket that is removeably positioned in the shredder housing and adapted to receive the material shredded by the plurality of shredder blades and ejected along the material discharge path. The shredder basket includes first and second lateral sides. The method also includes detecting when a light beam is interrupted to determine that the shredder basket is full of shredded material. The light beam extends through the first and second lateral sides of the shredder basket, extends generally laterally across the shredder basket, and is located generally outside of the material discharge path. The method includes interrupting the light beam when the shredder basket is not fully engaged with the shredder housing; and deactivating the plurality of shredder blades when the light beam is interrupted.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
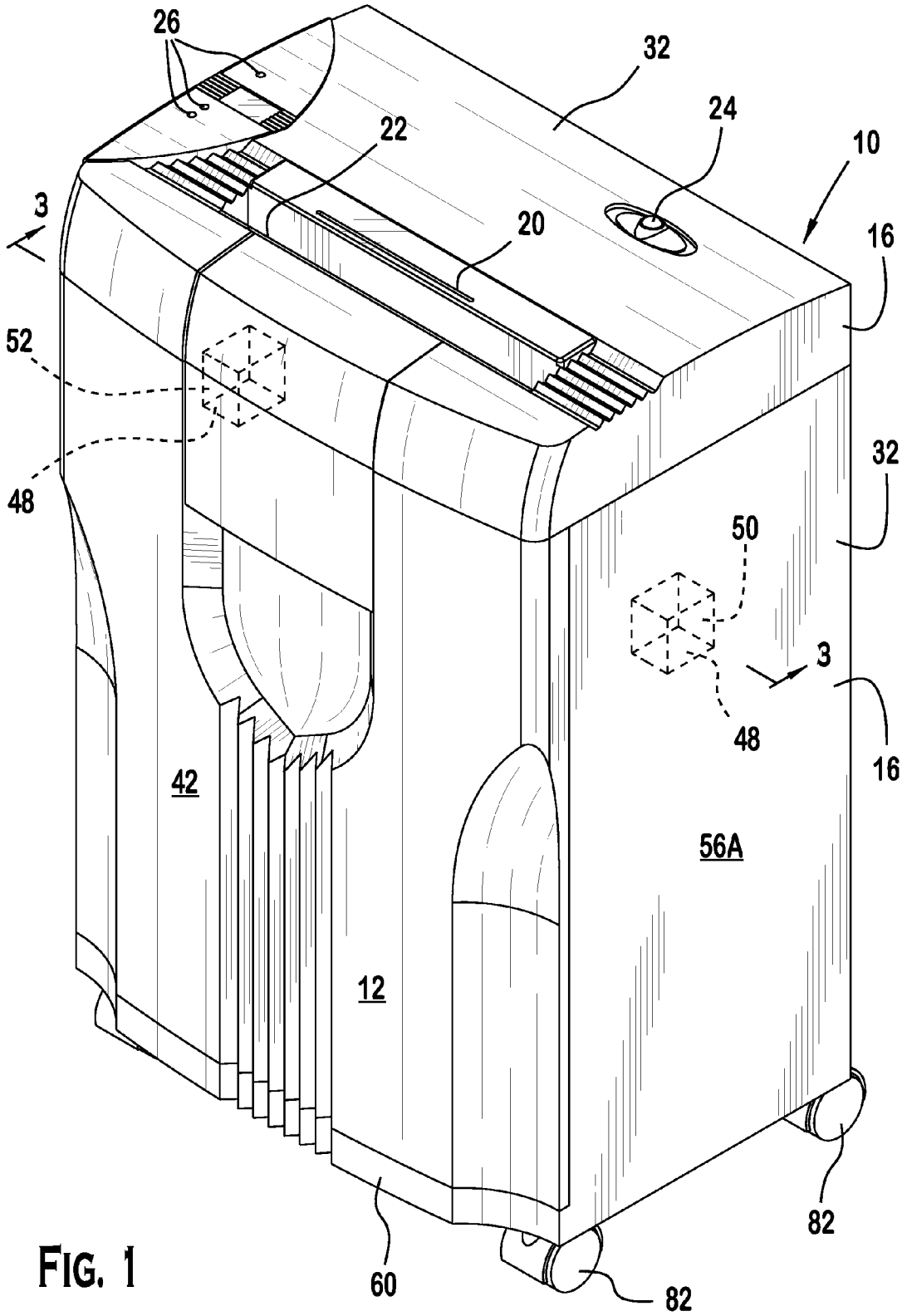
FIG. 1 is a perspective view of a shredder according to a preferred embodiment of the present invention; Sensors are shown on the left and right sides of the shredder in dashed lines that are preferably used to transmit and receive a light beam to determine when shredded material has reached a predetermined height in the shredder basket.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The term "selectable control", as used in the claims and the corresponding portions of the specification, means "any one of a physical switch, a touch switch, a button, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The language "at least one of 'A', 'B', and 'C'," as used in the claims and in corresponding portions of the specification, means "any group having at least one 'A'; or any group having at least one 'B';or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-15, wherein like numerals indicate like elements throughout, there are shown preferred embodiments of a shredder, designated as 10. Briefly speaking, the shredder 10 senses when the shredded material 14 accumulates in the shredder basket 12 to a sufficient level to block the light beam 80. When the shredded material 14 blocks the light beam 80, the shredder 10 stops the activation of the shredder blades.

Referring to FIGS. 1-4, one embodiment of the present invention is directed to a shredder adapted to automatically detect when an associated shredder basket is filled with shredded material. The shredder includes a shredder housing 16 that includes a chamber 18 and a shredder housing 16 which defines at least one slot 20, 22 that is adapted to receive material to be shredded. The chamber is preferably rectilinear and has an open front side for receiving the shredder basket 12.

The primary slot 20 guides material to be shredded to shredder blades 28. The plurality of shredder blades 28 are disposed within the shredder housing 16 and are adapted to shred material inserted into one of the slots 20, 22 and to eject the material 30 along a material discharge path 34. The chamber 30 is preferably located on another side of the shredder blades 28 from the slot 20, 22. The first slot 20 is preferably used for paper documents and the second slot 22 is preferably used for more rigid documents, such as credit cards, compact discs, etc.

The shredder housing 16 and basket 12 of the present invention are preferably constructed of a polymer for maximum rigidity. However, the shredder can be constructed by any suitable material without departing from the scope of the present invention.

Referring to FIG. 1, while the preferred shredder 10 has a generally rectilinear shape, those of ordinary skill in the art will appreciate from this disclosure that the shredder 10 can have any shape without departing from the scope of the present invention. The top surface of the shredder may also include other operational indicators.

Figure 2:
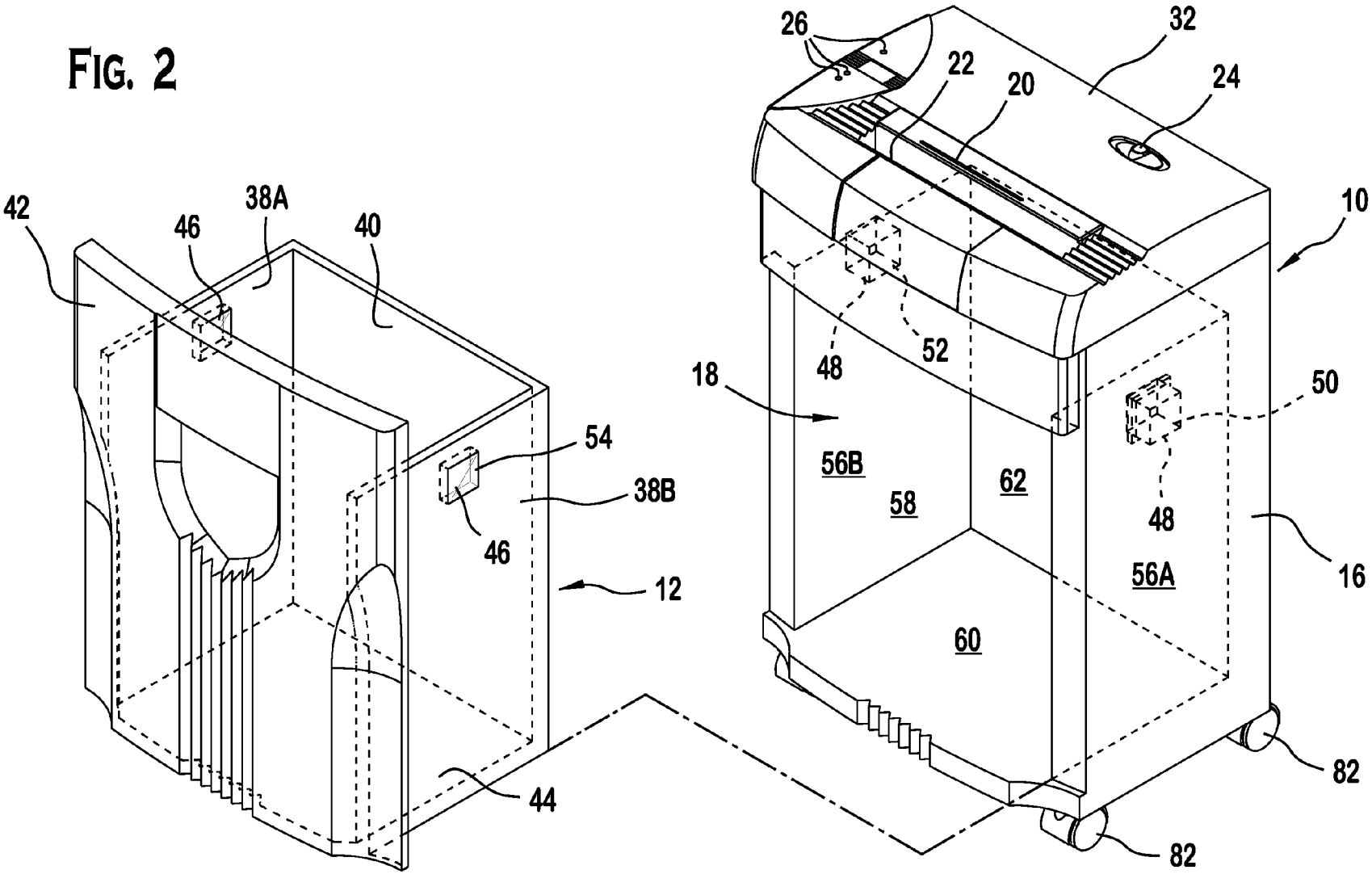
FIG. 2 is a perspective, exploded view of the shredder of FIG. 1 illustrating the shredder housing and basket according to a preferred embodiment of the present invention showing the path of insertion of the basket into the shredder housing; it is preferred that on an upper portion of the lateral sides of the shredder basket are light permeable sections, which may be holes or at least partially transparent material; The shredder housing includes lateral walls that define a chamber configured to receive the shredder basket; It is preferred that a sensor is engaged with at least one lateral wall; When the shredder basket is fully engaged with the shredder housing and properly located in the chamber, the light permeable section of the shredder basket is preferably aligned with the sensor(s)
Figure 3:
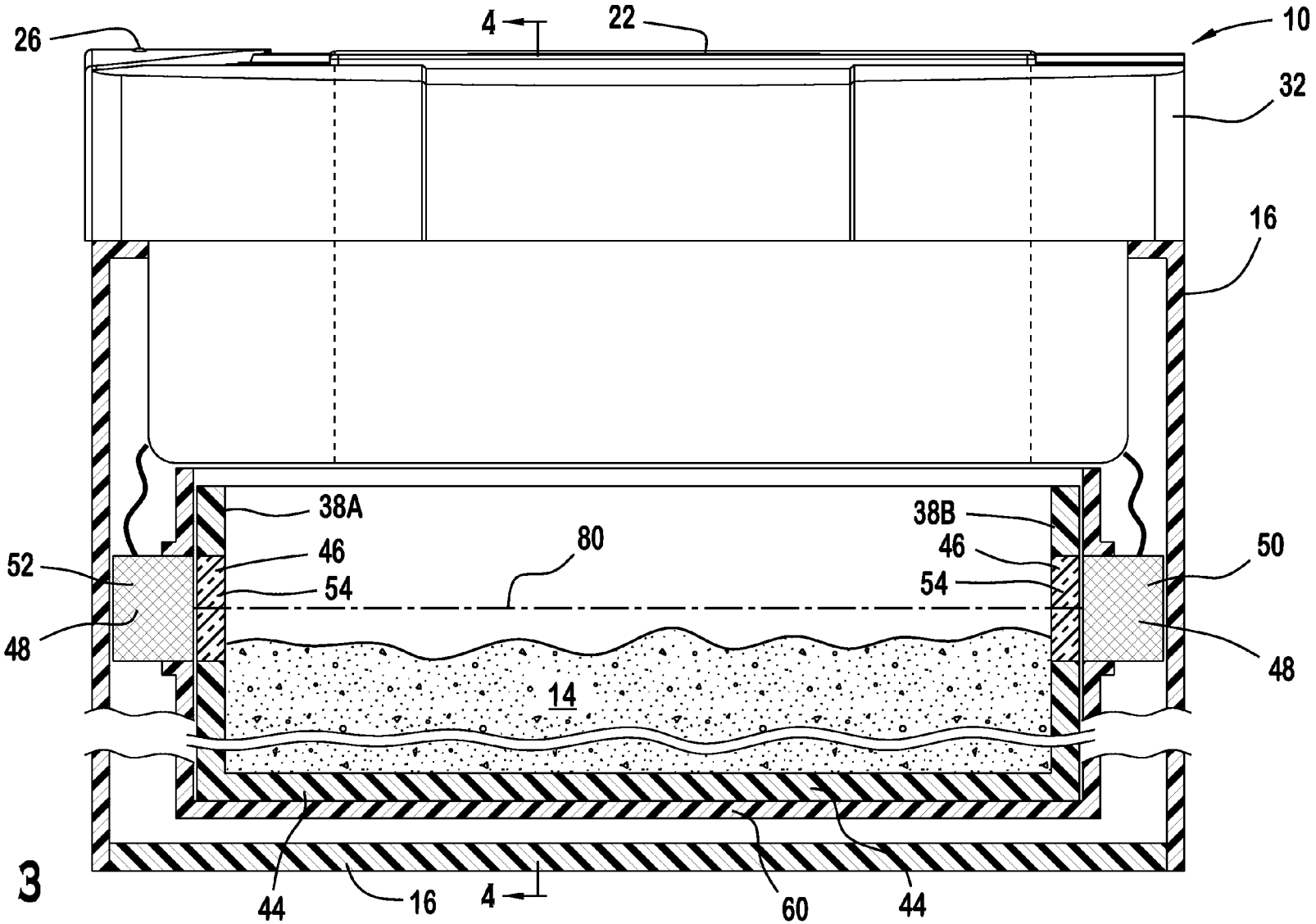
FIG. 3 is a cross-sectional view of the shredder of FIG. 1 as taken along the line 3-3 in FIG. 1 and illustrating the integrated shredder housing and basket along the line 3-3 of FIG. 1; A phantom line represents the light beam transmitted between the sensors and extending through the lateral sides of the shredder, generally laterally across the shredder basket, and located outside of the material discharge path (this aspect is more clearly shown in FIG. 4)

Referring to FIG. 2, the shredder basket 12 is removeably positioned in the chamber 18 and is adapted to receive the material shredded by the shredder blades and ejected along the material discharge path 34. The shredder basket includes first and second lateral sides 38A, 38B. The first and second lateral shredder basket sides 38A, 38B preferably each include a light permeable section 44. The light permeable section 44 can consist of a hole or a partially transparent/translucent section. It is preferred that the light permeable section have a generally rectilinear shape. However, those of ordinary skill in the art will appreciate from this disclosure that the light permeable section(s) can have any shape without departing from the scope of the present invention. For example, the light permeable section 44 may be triangular or formed by a slot/bore that opens to the top of the shredder basket so that the hole is not bounded on all sides by a portion of the shredder basket 12. Similarly, the shredder basket may include only a single light permeable section 44 without departing from the scope of the present invention. One method of implementing the shredder basket 12 with only a single light permeable section is to position a reflective area on the generally opposing portion of the inner surface of the shredder basket 12 to cause a single sensor 48 to transmit and receive light.

One or both of the first and second lateral shredder basket sides 38A, 38B may include a plate 68 that is moveable between a first position (shown in FIGS. 6 and 7), in which the plate 68 covers at least a portion of the light permeable section 46, and a second position (shown in FIG. 9), in which the plate 68 does not cover the light permeable section 48. The plate 68 preferably rotates about a torsion spring 70 and has one end that is generally circular which can cover the light permeable section 46 and another end which may be rectilinear and supports the protuberance 72. When the light permeable section 46 is a hole, the plate 68 provides the advantage of covering the hole when the basket is removed from the shredder 10 to prevent debris from falling through the hole while emptying the debris into a bag for disposal or performing other similar operations.

The protuberance 72 is preferably configured to abut a portion one of the first and second shredder side walls 56A, 56B so that the plate 68 is moveable between the first position and the second position. Alternatively, the plate 68 may be secured to a portion of the shredder housing 16 about a torsion spring or the like. The protuberance 72 may be configured to abut a portion of one of the first and second shredder basket walls 56A, 56B so that the plate is moved into the second position when the shredder basket 12 is fully inserted into the chamber 18.

While the preferred shredder basket 12 is generally positioned in the front of the shredder housing and inserts horizontally into the housing, those of ordinary skill in the art will appreciate from this disclosure that the shredder basket 12 can be inserted into any side of the shredder, or inserted along any path without departing from the scope of the present invention The shredder preferably receives power from an outlet via a power conduit, such as an electrical cord. However, the shredder can be powered by batteries or any other suitable power source.

Figure 4:
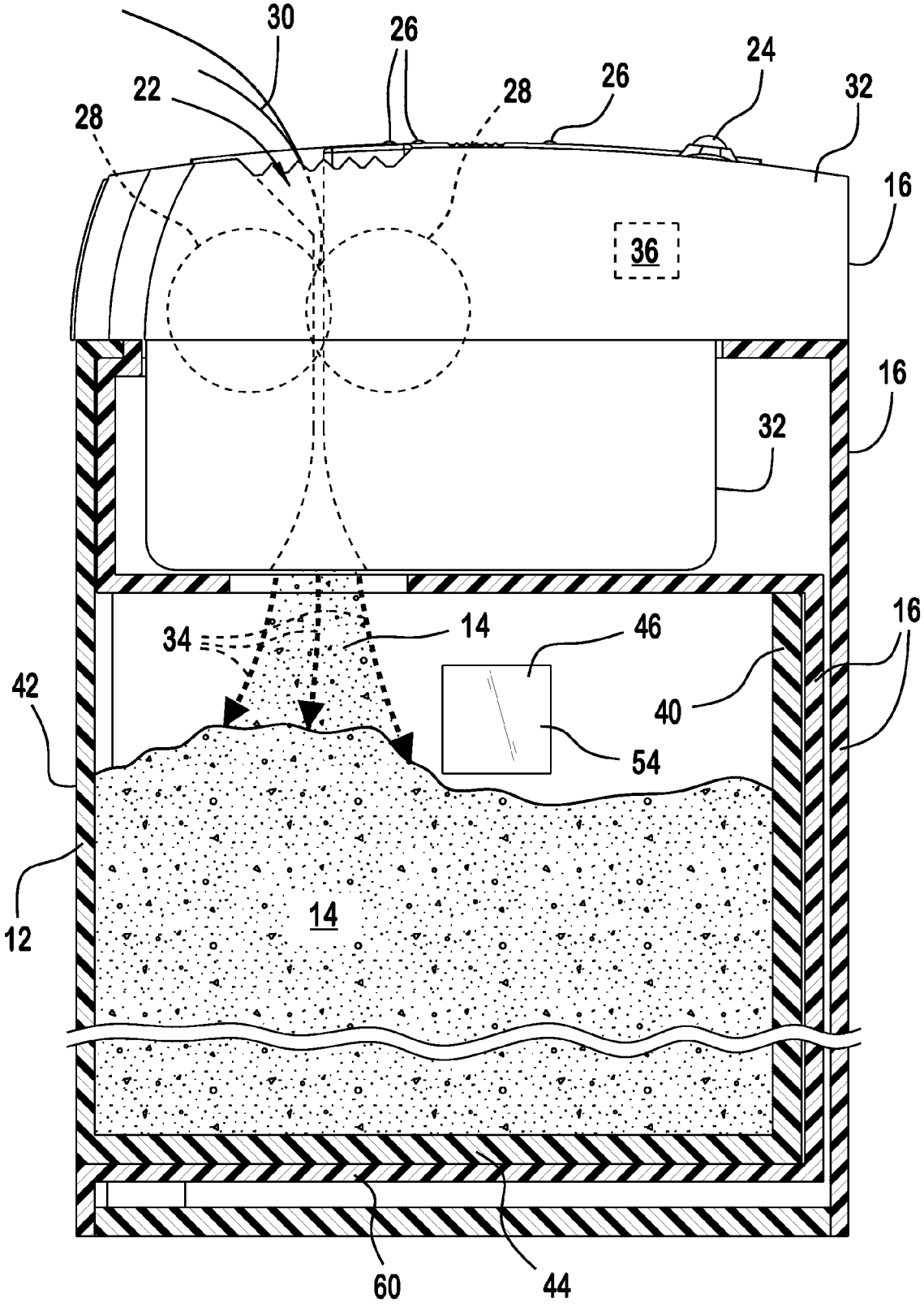
FIG. 4 is a cross-sectional view of the shredder of FIG. 3 as taken along the line 4-4 in FIG. 3 illustrating the integrated shredder housing and basket along the line 4-4 of FIG. 1 and illustrating the relationship of the shredder slot, shredder blades, material discharge path, and material accumulation sensor; the placement of the light permeable section shows that the light beam will be positioned outside of the material discharge path which is represented by downwardly fluted arrows that extend between the bottom of the shredder head housing and the top of the pile of collected shredded material.
Figure 5:
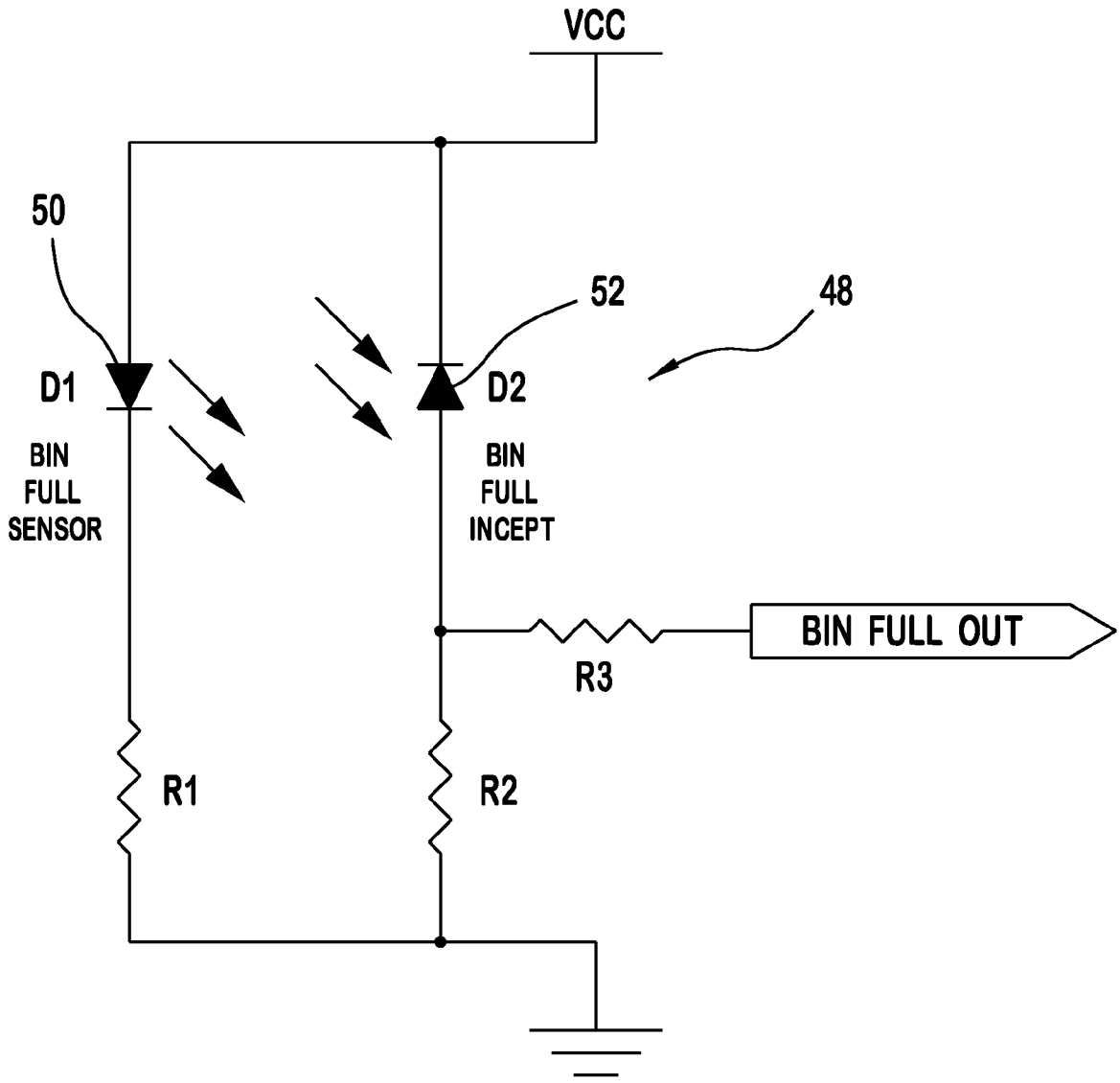
FIG. 5 is a preferred circuit diagram of a sensor and its output signal to a controller that may be used with the shredder of FIG. 1; any alternate suitable circuit or equivalent sensor can be used without departing from the scope of the present invention.
Figure 6:
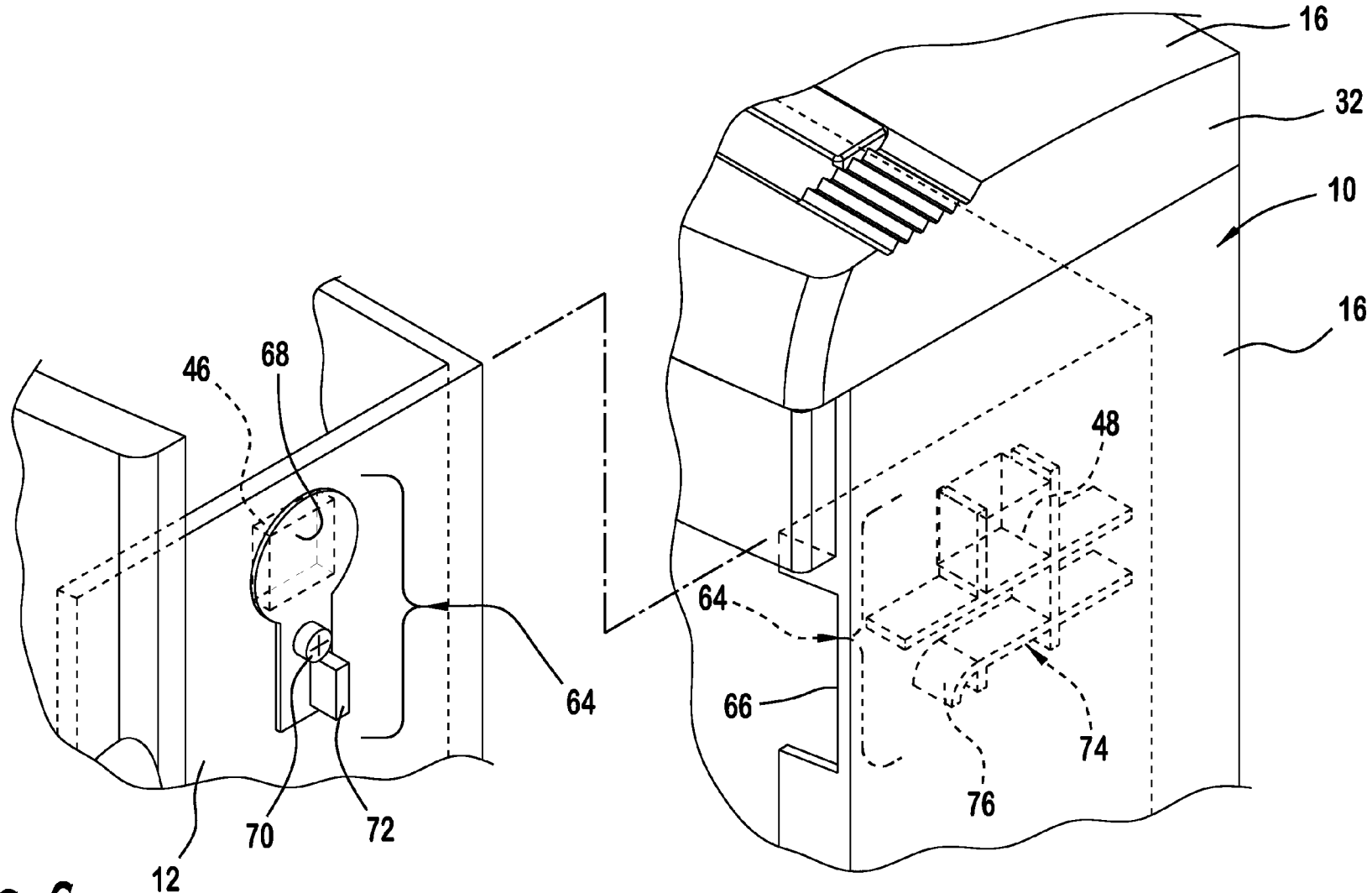
FIG. 6 is a perspective, broken away view of the shredder of FIG. 1 illustrating a moving plate on the shredder basket and the sensor position on the shredder housing, assembly lines also illustrate the path of insertion of the basket.
Figure 7:
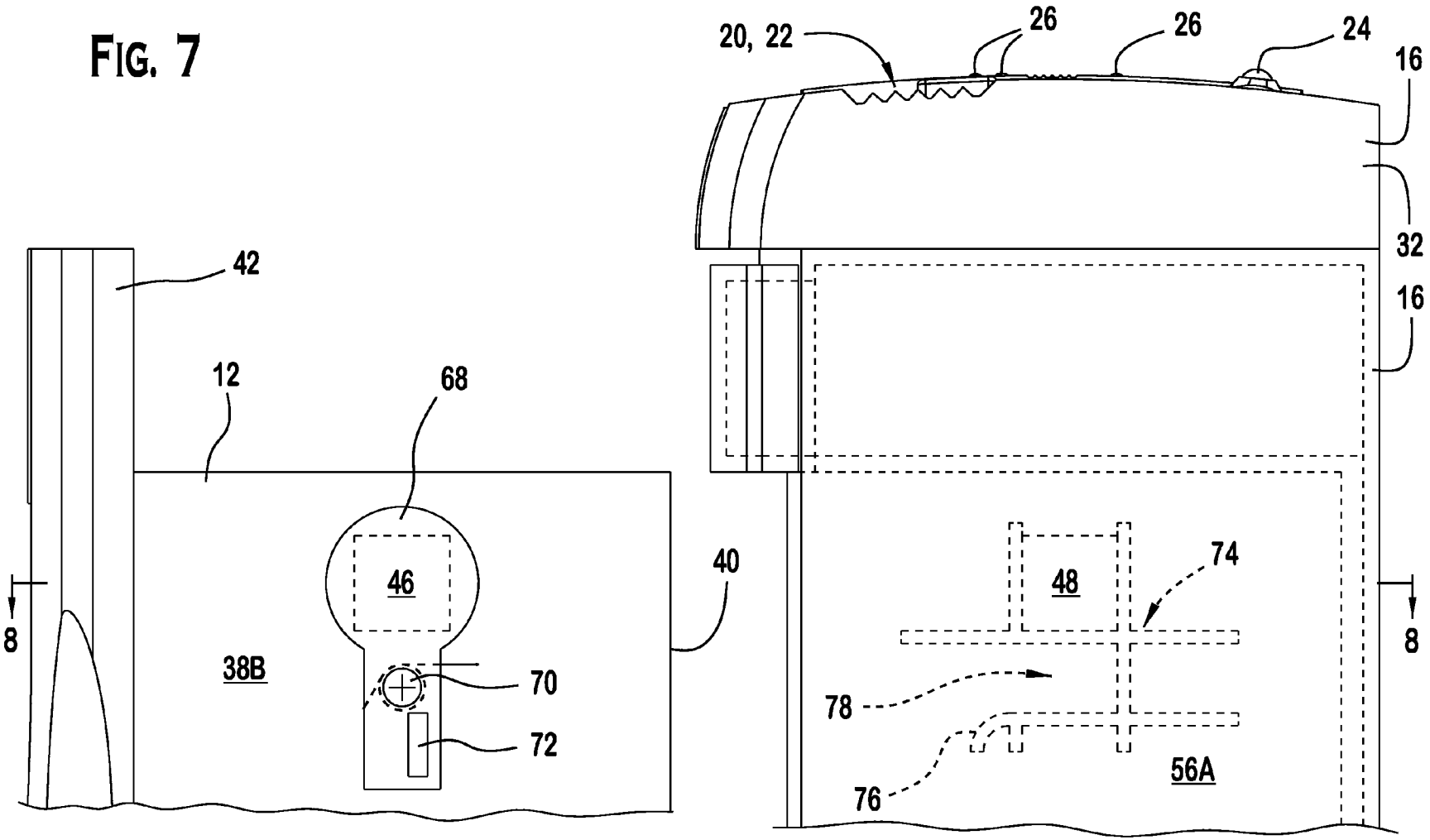
FIG. 7 is a side, elevational, broken away view of the shredder of FIG. 1, illustrating a plate on the shredder basket and the sensor position on the shredder housing; It is preferred that while the shredder basket is inserted into chamber, a protuberance located on the lower end of the plate abuts a ramp that is formed by lattice structure located in the chamber; The ramp guides the protuberance into a protuberance receiving slot that causes the plate to rotate generally clockwise to allow the sensor to align a light beam with the light permeable section of the shredder basket lateral wall.
Figure 8:
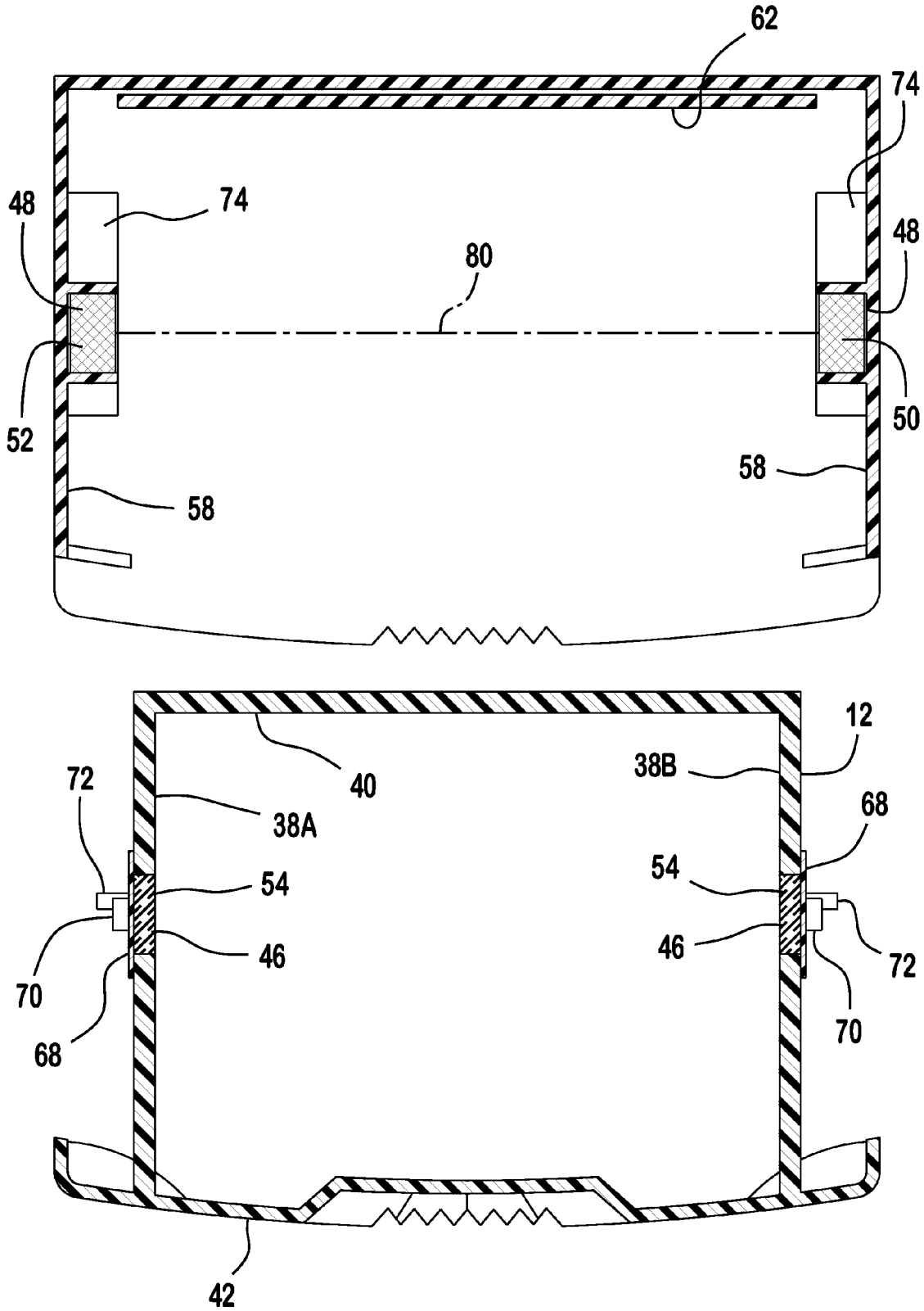
FIG. 8 is a preferred top, cross-sectional view of the shredder of FIG. 7 as taken along the line 8-8 in FIG. 7 illustrating the shredder housing and basket at the level of the light sensor and showing the light path used to detect the level of material in the shredder.
Figure 9:
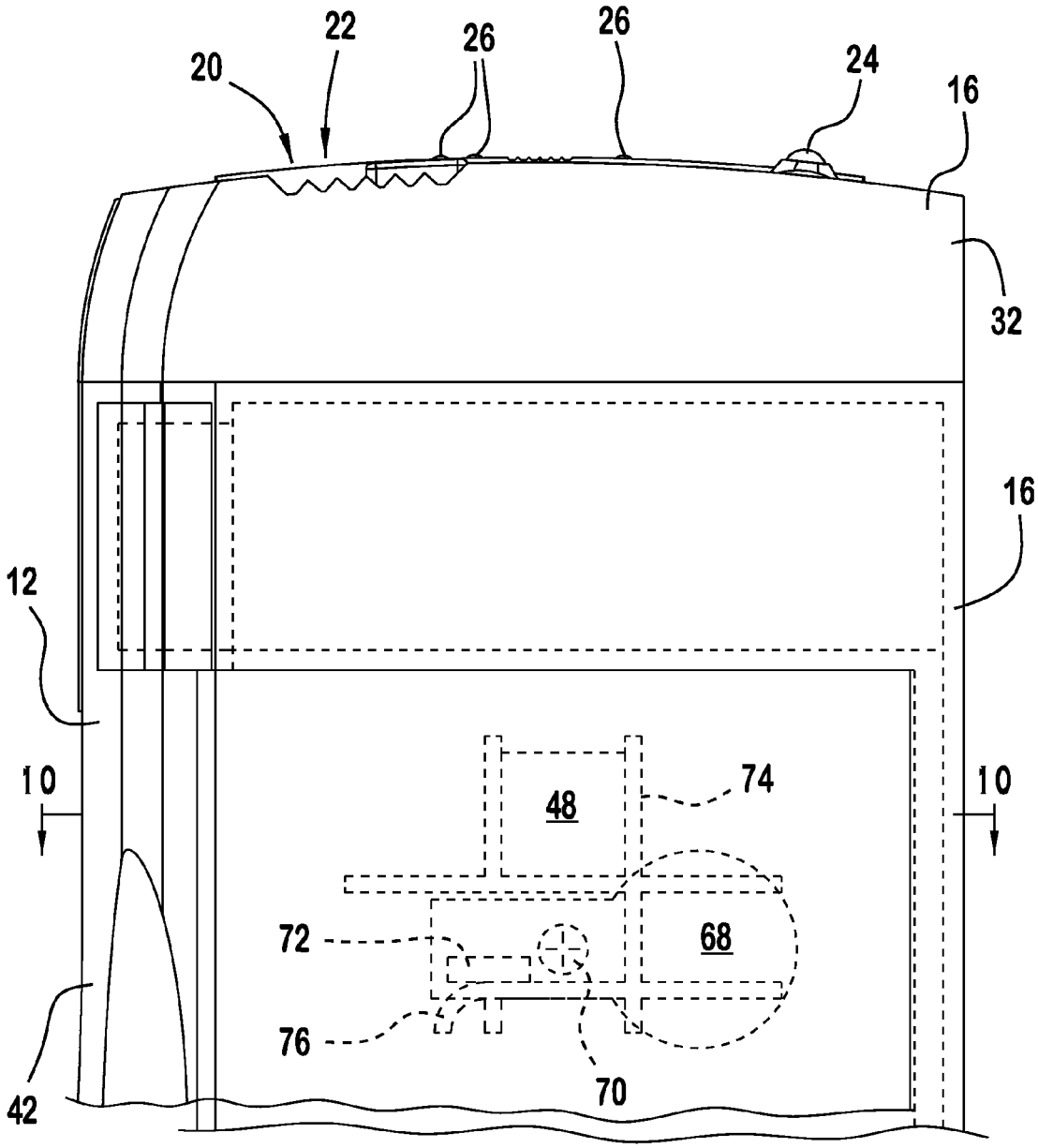
FIG. 9 is a side elevational, broken away view of the shredder of FIG. 1 illustrating the position of the movable plate when the basket is fully inserted into the housing.
Figure 10:
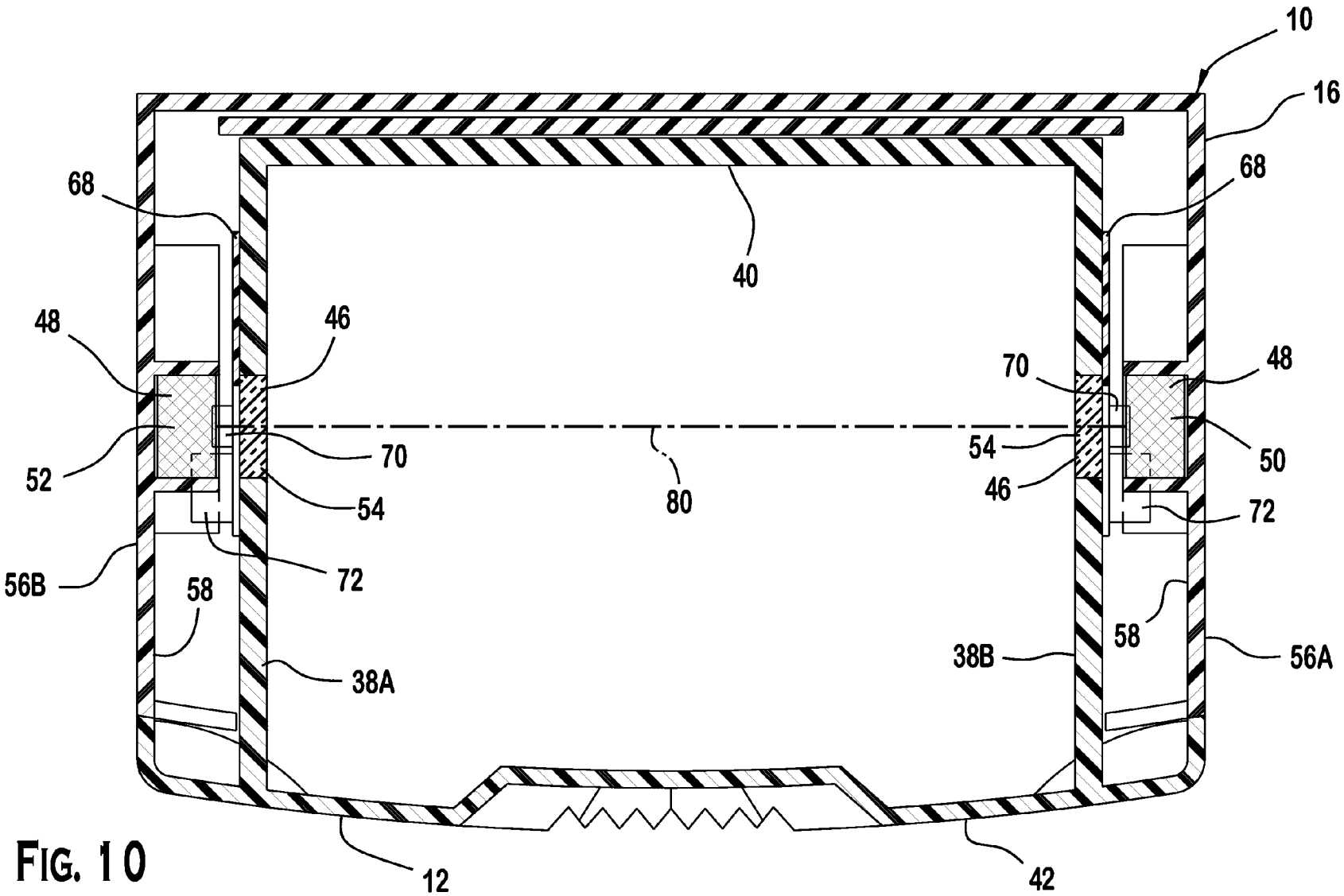
FIG. 10 is a top cross-sectional view of the shredder of FIG. 9 as taken along the line 10-10 in FIG. 9 illustrating the shredder housing with the basket in its fully inserted position (shown at the level of the light sensor) and illustrating the light path used to detect the level of material in the shredder.
Figure 11:
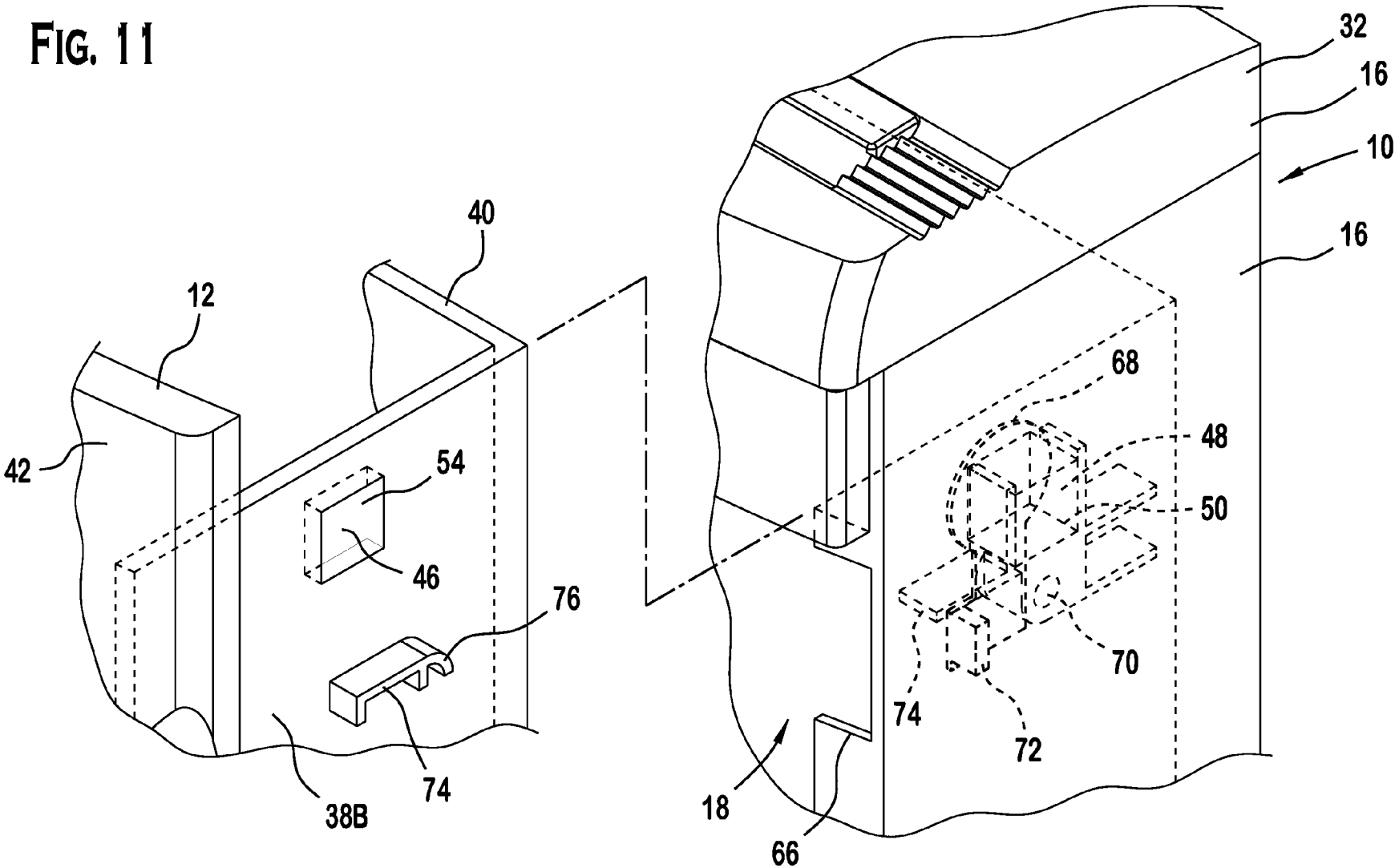
FIG. 11 is a perspective, partial view of a shredder according to a second preferred embodiment of the present invention; the light-permeable section on the basket is positioned above a ramp that abuts a movable plate on the shredder housing. The moveable plate covers the sensor.
Figure 12:
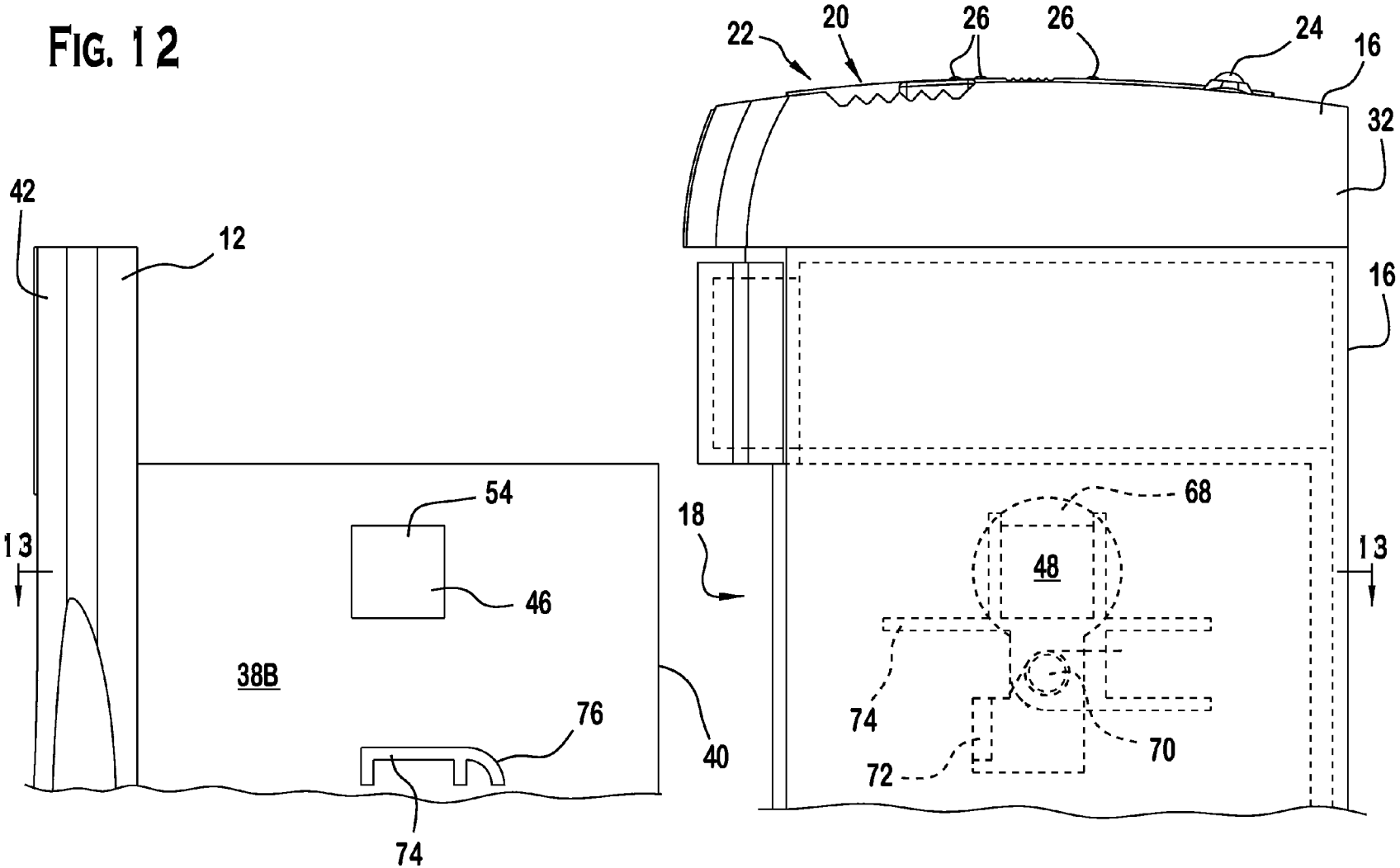
FIG. 12 is a side elevational view of the shredder of FIG. 11 illustrating the shredder housing and basket with the movable plate positioned to not interrupt the light beam while the basket is fully inserted into the housing.
Figure 13:
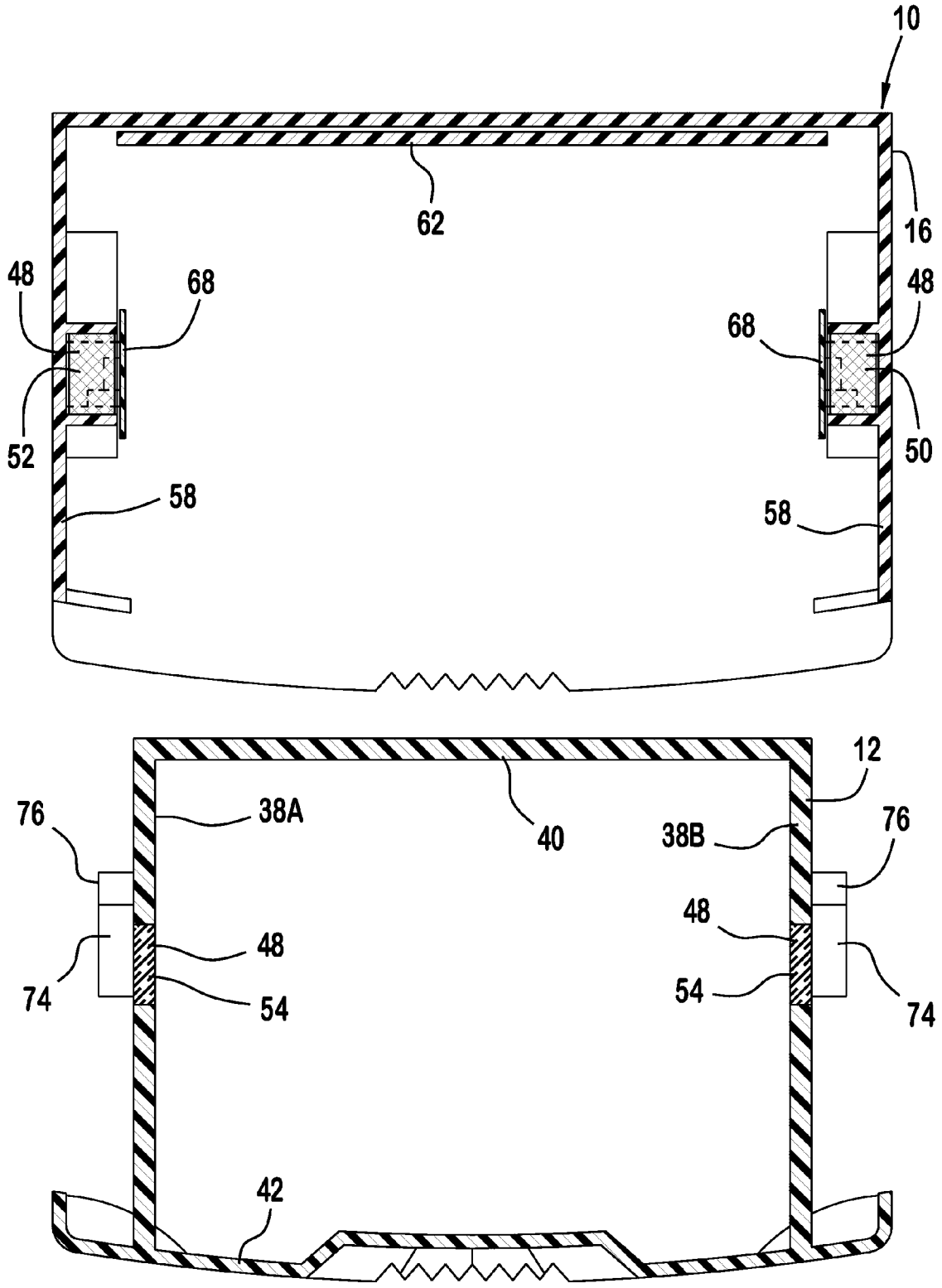
FIG. 13 is a top, cross-sectional view of the shredder of FIG. 12 as taken along the line 13-13 in FIG. 12 illustrating the housing and basket fully engaged, the cross sectional view is taken at the level of the light sensor, the light path is used to detect the level of material in the shredder.
Figure 14:
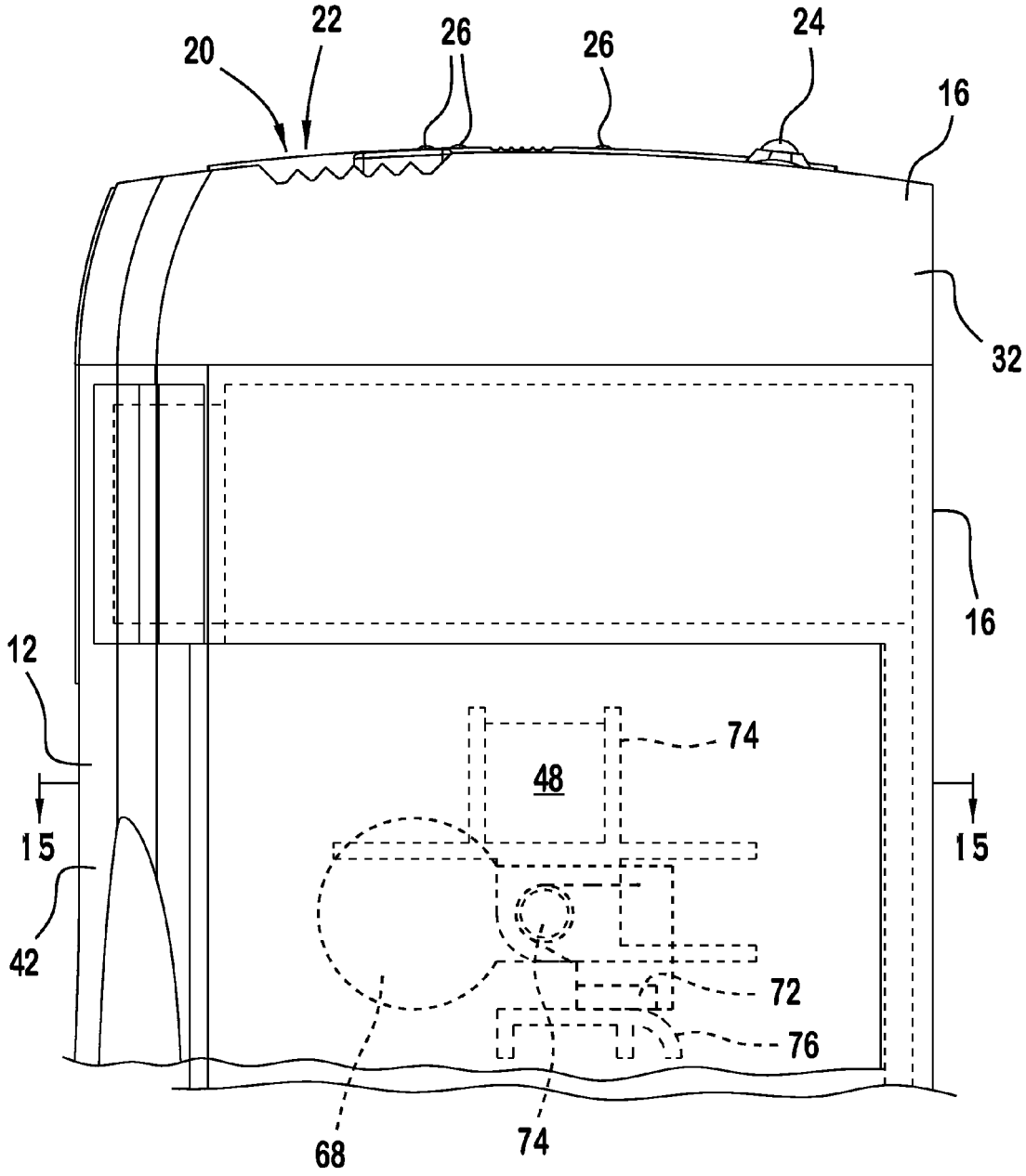
FIG. 14 is a side elevational view of the shredder of FIG. 11 illustrating the housing and basket showing the position of the movable plate when the basket is fully inserted into the housing.
Figure 15:
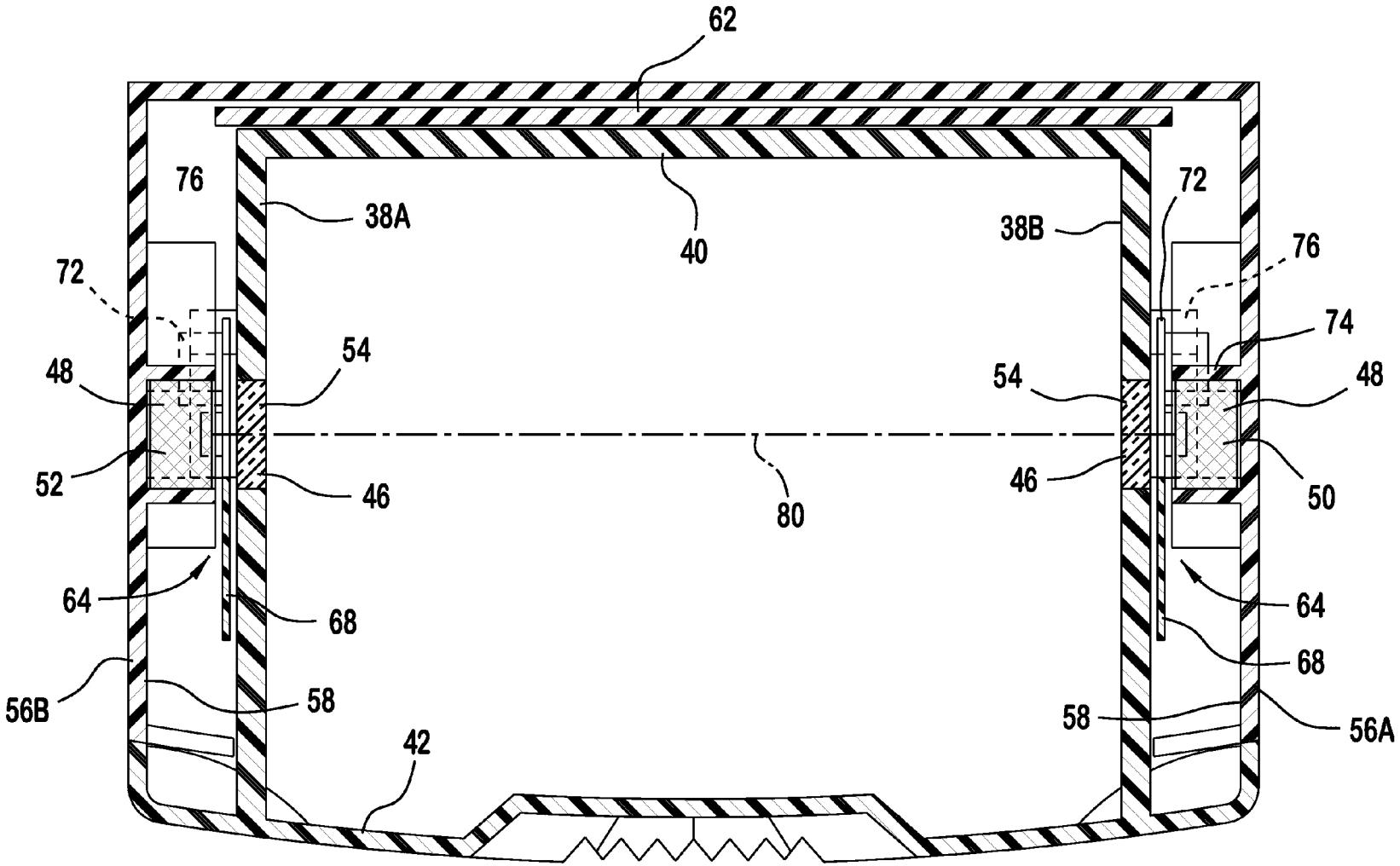
FIG. 15 is a top, cross-sectional view of the shredder of FIG. 14 as taken along the line 15-15 in FIG. 14 illustrating the housing and basket fully engaged, the light path used to detect the level of material in the shredder is shown in phantom lines and is not interrupted by the moving plate since the ramp that is located on the shredder basket maintains the plate in a rotated position.

Referring to FIG. 4, a controller 36 is preferably located in the shredder housing and is adapted to control the plurality of shredder blades. The controller 36 preferably deactivates the plurality of shredder blades 28 when accumulated material 14 or a blocking mechanism 64 interrupts the light beam 80. The controller 36 and sensor 48 can be integrated into a single device without departing from the scope of the present invention. It is preferred, but not necessary, that the controller 36 immediately deactivates the shredder blades 28 when the light beam 80 is interrupted.

Referring to FIGS. 1 and 2, the shredder 10 preferably includes a selectable control 24, such as a power switch, that is in communication with the shredder 10 and has an activated state adapted to configure the shredder 10 to automatically activate the plurality of shredder blades 28 when the material is fed into the slot 20, 22.

Referring to FIGS. 3, 5, 10, and 15, a sensor 48 that can include a light emitter 50 and light receiver 52 are preferably disposed at least partially within the shredder housing 16 and is adapted communicate with the controller 36. It is preferred that the sensor 48 is adapted to determine when a light beam 80 is interrupted by shredded material 14. when the basket 12 is properly seated in the shredder housing 16, the light emitter 50 transmits a light beam along the light path (both the light beam and path are shown as 80 in the drawings) which is detected by the light sensor 52. The light beam preferably extends through at least one of the first and second lateral sides 38A, 38B of the shredder basket 12, extends generally laterally across the shredder basket 12, and is located generally outside of the material discharge path 34. The light beam 80 is considered to extend generally laterally across the shredder basket 12 if it goes from one point on a shredder basket side to another point on a generally opposing side. The shredder basket can be configured to transmit the light beam 80 between the front and rear sides of the shredder basket 12 without departing from the scope of the present invention. Similarly, the sensor 48 may be located in the first and second lateral walls of the shredder basket 38A, 38B or the shredder walls 56A, 56B without departing from the scope of the present invention. The light beam 80 is considered to be generally outside of the material discharge path 34, if the amount of interruption by discharged material is satisfactory to a user.

While one preferred blocking mechanism 64 has been shown and described, those of skill in the art will appreciate from this disclosure that any suitable structure can be used to block the light beam 80, as desired without departing from the scope of the present invention. The blocking mechanism can be configured to interrupt the light beam 80 when the shredder basket 12 is not fully engaged with the chamber 18.

If the light path is interrupted by at least one of the shredded material 14, by the walls of the basket 16 on partial removal of the basket, or by the plate 68 on partial or full removal of the basket, the change in voltage across the light sensor 52 alerts the shredder controller 36 to cause the plurality of shredder blades 28 to deactivate. The light detection mechanism is preferably, but not necessarily, formed by a diode pair comprising a light emitting diode and a light detecting diode. However, those of ordinary skill in the art will appreciate from this disclosure that any type of light emitter and light sensor can be used to detect accumulation of shredded material, and any signal can be used to alert the shredder controller of the interruption of the light beam, without departing from the scope of the present invention.

Referring to FIGS. 6-10, one embodiment of the present invention includes on each side of the basket 12, a plate 68, torsion spring 70, and protuberance 72. When the basket enters the shredder housing 16, the protuberance 72 contacts the ramp 76, which causes the torsion spring 70 to rotate. The rotation causes the plate 68 to uncover the light permeable section 46 of the basket, and allows the protuberance 72 to enter the protuberance receiving slot 74. When the basket 12 is fully inserted, the light permeable section 46 is preferably fully uncovered. In this manner the light emitter 50 can transmit the light beam 80 through the light permeable section 46 of the basket to the light receiver 52. When the basket 12 is removed from the shredder housing, the removal of the protuberance 72 from the protuberance receiving slot 74 causes the torsion spring 70 to rotate. The rotation causes the plate 68 to cover at least part of the light permeable section 46 of the basket. Those of ordinary skill in the art will appreciate from this disclosure that any type of mechanism can be used to cover the light permeable section 46 of the basket upon its removal from the shredder housing 16 without departing from the scope of the present invention.

Referring to FIGS. 11-15, one embodiment of the present invention includes on each side of the shredder housing 16, a plate 68, torsion spring 70, and protuberance 72. When the basket enters the shredder housing 16, the ramp 76 contacts the protuberance 72, which causes the torsion spring 70 to rotate. The rotation causes the plate 68 to uncover the light emitter 50. When the basket 12 is fully inserted, the light emitter 50 may be fully uncovered. In this manner the light emitter 50 can transmit the light beam 80 through the light permeable section 46 of the basket to the light receiver 52. When the basket 12 is removed from the shredder housing, the movement of the lattice gridwork 74 allows the torsion spring 70 to rotate. The rotation causes the plate 68 to cover the light emitter 50. Those of ordinary skill in the art will appreciate from this disclosure that any type of mechanism can be used to cover the light emitter 50 upon removal of the basket 12 from the shredder housing 16 without departing from the scope of the present invention. In addition, any combination of mechanical, optical, and electrical elements can be used to interrupt emission of light by the light emitter 50 upon removal of the basket 12 without departing from the scope of the present invention.

Multiple preferred methods of the present invention will be described below (alone or in combination with various embodiments of the shredder 10). The steps of the methods of the present invention can be performed in any order, omitted, or combined without departing from the scope of the present invention. As such, optional or required steps described in conjunction with one method can also be used with another method or omitted altogether. Additionally, unless otherwise stated, similar structure or functions described in conjunction with one method preferably, but not necessarily, operate in a generally similar manner to that described elsewhere in this application.

One preferred method of the present invention is directed to a method of detecting when a shredder basket is filled with shredded material. A shredder housing may be provided that includes a shredder head housing which defines a slot adapted to receive material to be shredded. A plurality of shredder blades are provided that are disposed within the shredder housing and are adapted to shred the material inserted into the slot and to eject the material along a material discharge path. A shredder basket is provided that is removeably positioned in the shredder housing and is adapted to receive the material shredded by the plurality of shredder blades and ejected along the material discharge path. The shredder basket includes first and second lateral sides.

The method includes detecting when a light beam is interrupted to determine that the shredder basket is full of shredded material. The light beam extends through the first and second lateral sides of the shredder basket, extends generally laterally across the shredder basket, and is located generally outside of the material discharge path. The plurality of shredder blades are deactivated when the light beam is interrupted.

The method may include immediately deactivating the plurality of shredder blades when the light beam is interrupted. The method may also include providing a mechanism positioned on the shredder basket that is adapted to interrupt the light beam and interrupting the light beam when the shredder basket is not fully engaged with the shredder housing.

The method may include providing a mechanism positioned on the shredder housing that is adapted to interrupt the light beam and interrupting the light beam when the shredder basket is not fully engaged with the shredder housing. The method may include interrupting the light beam when the shredder basket is not fully engaged with the shredder housing.

A second preferred method of detecting when a shredder basket is filled with shredded material is as follows. A shredder housing is provided that includes a shredder head housing which defines a slot adapted to receive material to be shredded. A plurality of shredder blades are provided and are disposed within the shredder housing and adapted to shred the material inserted into the slot and to eject the material along a material discharge path. A shredder basket is provided that is removeably positioned in the shredder housing and is adapted to receive the material shredded by the plurality of shredder blades and ejected along the paper material discharge path. The shredder basket includes first and second lateral sides. The method includes detecting when a light beam is interrupted to determine that the shredder basket is full of shredded material. The light beam preferably extends through the first and second lateral sides of the shredder basket, preferably extends generally laterally across the shredder basket, and is preferably located generally outside of the material discharge path. The method includes interrupting the light beam when the shredder basket is not fully engaged with the shredder housing and deactivating the plurality of shredder blades when the light beam is interrupted.

Referring to FIGS. 1-10, one embodiment of the present invention operates as follows. The first and second lateral sides of the basket 12 include a moveable plate 68. When the basket 12 is not fully engaged with the shredder housing 16, the plate is in its first position and covers the light permeable section 46 of the basket. The light permeable section 46 may be free of material in order to optimize the operation of the light emitter 50 and light receiver 52. When the basket 12 is fully engaged with the shredder housing 16, the moveable plate 68 moves into its second position and a clear light path exists between the light emitter 50 and light receiver 52. When the selectable control 24 is activated, the light emitter 50 is activated and a light beam 80 extends through the first and second lateral sides of the basket 12. The shredder 10 is configured to automatically activate the plurality of shredder blades 28 when the material 30 is fed into the slot 20, 22. The shredded material is ejected along the material discharge path 34 into the basket 12. The light beam 80 is located generally outside the material discharge path 34. If the accumulated shredded material 14 interrupts the light path, the sensor 48 alerts the shredder controller 36 to cause the plurality of shredder blades 28 to deactivate. When the basket 12 is removed from the shredder housing 15, the plate 68 moves to its first position and covers the light permeable section 46 of the basket. In this position the plate 68 prevents shredded material 14 from exiting the basket through the light permeable section.

It is recognized by those skilled in the art that changes may be made to the above described methods and/or shredder 10 without departing from the broad inventive concept thereof It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A shredder adapted to automatically detect when an associated shredder basket is filled with shredded material, comprising:

a shredder housing comprising a chamber and a shredder head housing which defines a slot adapted to receive material to be shredded;

a plurality of shredder blades disposed within the shredder housing and adapted to shred the material inserted into the slot and to eject the material along a material discharge path, the chamber being located on another side of the plurality of shredder blades from the slot;

a controller located in the shredder housing and adapted to control the plurality of shredder blades;

a shredder basket removeably positioned in the chamber and adapted to receive the material shredded by the plurality of shredder blades and ejected along the material discharge path, the shredder basket comprising first and second lateral sides, wherein the first and second lateral sides of the shredder basket each comprise a light permeable section;

a sensor in communication with the controller to determine when a light beam is interrupted by shredded material in the basket, the light beam extending through at least one of the first and second lateral sides of the shredder basket, extending generally laterally across the shredder basket, and being located generally outside of the material discharge path; and wherein the controller deactivates the plurality of shredder blades when accumulated material in the shredder basket interrupts the light beam.

2. The shredder of claim 1, wherein the first and second lateral sides of the shredder basket each define a bore therethrough which forms the light permeable section.

3. The shredder of claim 1, wherein the first and second lateral sides of the shredder basket each comprise a section that is at least partially transparent to form the light permeable section.

4. The shredder of claim 1, wherein the sensor comprises a light transmitter and a light receiver.

5. The shredder of claim 4, wherein the shredder housing comprises first and second shredder walls which define lateral sides of the chamber, the light transmitter and the light receiver each being located on a separate one of the first and second shredder walls.

6. The shredder of claim 5, wherein each of the first and second lateral sides of the shredder basket includes a plate, each of the plates is moveable between a first position, in which the plate covers the light permeable section, and a second position, in which the plate does not cover the light permeable section.

7. The shredder of claim 6, wherein the plate is rotateably secured to the shredder basket about a torsion spring.

8. The shredder of claim 7, wherein the plate further comprises a protuberance configured to abut a portion of one of the first and second shredder side walls so that the plate is moved into the second position when the shredder basket is fully inserted into the chamber.

9. The shredder of claim 5, wherein each of the first and second shredder walls comprises a plate, each of the plates is moveable between a first position, in which the plate covers at least a portion of the sensor, and a second position, in which the plate does not cover the sensor.

10. The shredder of claim 9, wherein the plate is rotateably secured to the shredder housing about a torsion spring.

11. The shredder of claim 10, wherein the plate further comprises a protuberance configured to abut a portion of one of the first and second shredder basket walls so that the plate is moved into the second position when the shredder basket is fully inserted into the chamber.

12. The shredder of claim 1, wherein the controller deactivates the plurality of shredder blades immediately in response to the sensor determining that the light beam has been interrupted.

13. A method of detecting when a shredder basket is filled with shredded material, comprising:

providing a shredder housing comprising a shredder head housing which defines a slot adapted to receive material to be shredded;

providing a plurality of shredder blades disposed within the shredder housing and adapted to shred the material inserted into the slot and to eject the material along a material discharge path;

providing a shredder basket that is removeably positioned in the shredder housing and adapted to receive the material shredded by the plurality of shredder blades and ejected along the material discharge path, the shredder basket comprising first and second lateral sides;

detecting when a light beam is interrupted to determine that the shredder basket is full of shredded material, the light beam extending through at least one of the first and second lateral sides of the shredder basket, extending generally laterally across the shredder basket, and being located generally outside of the material discharge path; and deactivating the plurality of shredder blades when the light beam is interrupted;

providing a mechanism positioned on the shredder basket that is adapted to interrupt the light beam; and interrupting the light beam when the shredder basket is not fully engaged with the shredder housing.

* * * * *